US006070842A

United States Patent [19]

Sandahl

[11] Patent Number: 6,070,842

[45] Date of Patent: Jun. 6, 2000

[54] CLIMBING CHOCK HAVING MULTIPLE CONCAVE SURFACES

[75] Inventor: Brooke Henry Sandahl, Bend, Oreg.

[73] Assignee: Metolius Mountain Products, Inc., Bend, Oreg.

[21] Appl. No.: 09/132,001

[22] Filed: Aug. 10, 1998

[51] Int. Cl.[7] ..... A47F 5/08

[52] U.S. Cl. ..... 248/231.9; 248/694; 248/925

[58] Field of Search ..... 248/231.9, 694, 248/925, 317

[56] References Cited

U.S. PATENT DOCUMENTS

| | | | |
|---|---|---|---|
| 910,192 | 1/1909 | Grouvelle et al. | 138/38 |
| 3,903,785 | 9/1975 | Pepper, Jr. | 248/694 |
| 3,946,975 | 3/1976 | Lyman, Jr. | 248/694 |
| 3,948,485 | 4/1976 | Chouinard et al. | 248/694 |
| 3,957,237 | 5/1976 | Campbell | 248/694 |
| 4,044,976 | 8/1977 | Campbell | 248/694 |
| 4,069,991 | 1/1978 | Saunder et al. | 248/694 |
| 4,074,880 | 2/1978 | Simond | 248/694 |
| 4,082,241 | 4/1978 | Burkey | 248/317 |
| 4,083,521 | 4/1978 | Greiner, II | 248/694 |
| 4,422,607 | 12/1983 | Vallance | 248/694 |

FOREIGN PATENT DOCUMENTS

| | | |
|---|---|---|
| 2 396 562 | 2/1979 | France . |
| 2 447 207 | 8/1980 | France . |

*Primary Examiner*—Anita M. King
*Attorney, Agent, or Firm*—Robert D. Varitz, PC

[57] ABSTRACT

A climbing chock includes a chock body which has an irregular tubular configuration with multiple bearing surfaces thereon. At least two of the surfaces are convex in shape and at least one of the surfaces is flat. The chock includes a sling which is attached to the chock body for supporting a climber.

2 Claims, 1 Drawing Sheet

CLIMBING CHOCK HAVING MULTIPLE CONCAVE SURFACES

FIELD OF THE INVENTION

This invention relates to climbing aids, and specifically to a climbing chock having multiple, irregularly shaped bearing surfaces.

BACKGROUND OF THE INVENTION

A great variety of climbing chocks are known. Perhaps the most basic form of climbing chock is a simple wedge which is used, in a variety of sizes, to provide a support point for a climber. While the wedge has been quite successful, there are a number of situations in which the regularly shaped wedge with its flat sides does not provide as much security as may be desired. The wedge tends to provide a point contact on an irregular surface, which may allow the wedge to shift or slip.

A variation of the climbing wedge is the climbing nut, such as that shown in U.S. Pat. No. 3,948,485 to Chouinard et al. This climbing chock features a number of flat sides with provisions for a sling to be passed through the center of the climbing chock. Again, there are many instances when this device will result in point contact, and will not provide the required degree of support.

Chocks with irregular surfaces are disclosed in U.S. Pat. No. 4,422,607 to Vallance, U.S. Pat. No. 4,083,521 to Greiner II, and U.S. Pat. No. 4,044,976 and U.S. Pat. No. 3,957,237, both to Campbell.

As is evident from the drawings illustrating the use of the various climbing chocks in the above-identified patents, specific shaped chocks are suitable for a particular type of flaw, crevice, or crack, however, the configuration of the chocks do not provide a single style chock which may be used in a wide variety of rock configurations.

SUMMARY OF THE INVENTION

The climbing chock of the invention includes a chock body which has an irregular tubular configuration with multiple bearing surfaces thereon. At least two of the surfaces are convex in shape and at least one of the surfaces is flat. The chock includes a sling which is attached to the chock body for supporting a climber.

It is an object of the invention to provide a climbing chock which will easily fit into a variety of natural flaws, crevices, and cracks.

Another object of the invention is to provide a climbing chock which is hand positionable.

Yet another object of the invention is to provide a climbing chock which does not require the placement of technical climbing devices.

Another object of the invention is to provide a climbing chock having a variety of surfaces which will provide contact with the rock over a large area, or, at a minimum, will provide a multi-point contact on a single bearing surface.

These and other objects and advantages of the invention will become more fully apparent as the description which follows is read in connection with the drawings.

DETAILED DESCRIPTION OF THE PREFERRED EMBODIMENT

Figure 1:
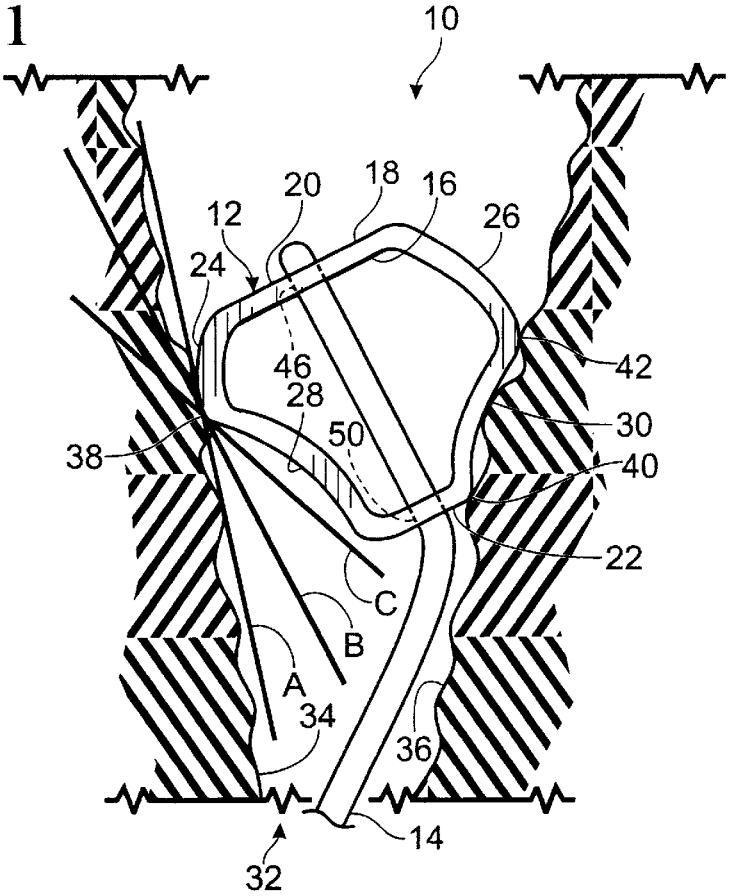
FIG. 1 is an end elevation of the climbing chock of the invention in an environmental setting.
Figure 2:
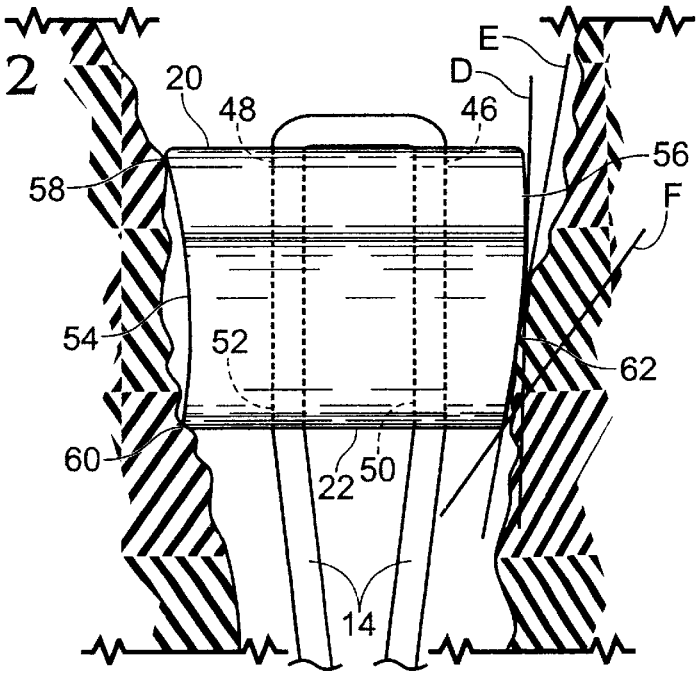
FIG. 2 is a side elevation of the climbing chock of the invention.

Referring now to FIGS. 1 and 2, the climbing chock of the invention is depicted generally at 10. Chock 10 includes a chock body 12 and a sling 14, which is attached to body 12. Body 12 is formed, in the preferred embodiment, of an extruded metal material, such as aluminum, and has an irregular tubular configuration, with multiple bearing surfaces thereon. Body 12 has an interior surface 16 and an exterior surface 18. Flat bearing surfaces are depicted at 20 and 22, convex bearing surfaces are depicted at 24 and 26, concave bearing surfaces are depicted at 28 and 30. The ends of the chock are curved, and will be described in greater detail later herein.

As shown in FIG. 1, chock 10 is in an environmental setting being located in a crevice 32 having walls 34 and 36. As depicted, wall 34 makes point contact with chock 10 at point 38, which is the junction between concave bearing surface 28 and convex bearing surface 24. Wall 36 is in multiple-point contact with bearing surface 30 at contact points 40 and 42. It will be appreciated that in the event that a sufficient load is placed on chock 10 to cause a failure of wall 34 adjacent contact point 38, the chock would shift, bringing bearing surface 28 into contact with wall 34. Downward force on chock body 12 is provided by sling 14, which is fastened to chock body 12 through bores 46, 48, and 50, 52 which, in this embodiment, extend through flat bearing surfaces 20, 22, respectively. Sling 14 is formed into a loop with body 12 retained therein. A carabineer may be placed in the loop of the chock and a climbing rope placed in the carabineer to support a climber.

As is depicted in FIG. 1, contact point 38 is effective to hold chock 10 in place so long as there is any inward slope of wall 34 relative to wall 36, such as is indicated by lines A, B and C. Chock 10 will always be in contact with the crevice wall at a minimum of three points due to its irregular configuration.

Turning now to FIG. 2, chock 10 is placed in a crevice length-ways, using the curved ends thereof to also provide a three-point contact with the crevice. End bearing surfaces 54, 56 are concave and convex, respectively. Concave end surface 54 bears on the crevice wall at contact points 58, 60, while convex end bearing surface 56 bears on the opposite crevice wall at contact point 62. Again, chock 10 will be held in place regardless of the slop of the crevice walls so long as there is some relative inward slope between the crevice walls, as shown by lines D, E and F.

Although a preferred embodiment of the invention has been disclosed, it will be appreciated that further variations and modifications may be made thereto without departing from the scope of the invention as defined in the appended claims.

What is claimed is:

1. A climbing chock comprising:

a chock body having an irregular tubular configuration, including multiple bearing surfaces about the periphery thereof, wherein said chock body has bores formed therein and wherein at least two of the bearing surfaces are concave, at least two of the bearing surfaces are convex, and at least one of the bearing surfaces is flat, wherein the ends of said chock body are open, and wherein the ends of the chock include one concave bearing surface and one convex bearing surface; and a sling attached to said chock body through said bores for supporting a climber.

2. A climbing chock comprising:

a chock body having an irregular tubular cross section, including multiple bearing surfaces about the periphery thereof and on the ends thereof, wherein at least two of the peripheral bearing surfaces are concave, at least two of the peripheral bearing surfaces are convex, and at least one of the peripheral bearing surfaces is flat, and wherein the ends of the chock are open and include one concave surface and one convex surface, wherein said chock body has bores formed therein; and a sling trained through said bores for supporting a climber.

* * * * *